United States Patent [19]

Gerbasi et al.

[11] 4,264,191

[45] Apr. 28, 1981

[54] ELECTROPHOTOGRAPHIC IMAGING SYSTEM INCLUDING A LAMINATED CLEANING AND/OR DOCTOR BLADE

[75] Inventors: Dennis P. Gerbasi, Webster; Rabin Moser, Fairport, both of N.Y.

[73] Assignee: Xerox Corporation, Stamford, Conn.

[21] Appl. No.: 86,973

[22] Filed: Oct. 22, 1979

[51] Int. Cl.[3] ..... G03G 21/00

[52] U.S. Cl. ..... 355/15; 15/256.51; 118/652

[58] Field of Search ..... 355/15; 430/125; 118/652; 15/256.51, 256.53, 250.36

[56] References Cited

U.S. PATENT DOCUMENTS

| | | | |
|---|---|---|---|
| 2,187,421 | 1/1940 | George | 15/256.51 |
| 2,333,172 | 11/1943 | Grupe | 101/157 |
| 3,001,221 | 9/1961 | Wojciechowski | 15/250.36 |
| 3,606,630 | 9/1971 | Haas | 15/250.36 |
| 3,660,863 | 5/1972 | Gerbasi | 15/256.51 |
| 3,936,183 | 2/1976 | Sadamatsu | 355/15 |
| 4,045,838 | 9/1977 | Porter | 15/250.36 |

*Primary Examiner*—R. L. Moses

*Attorney, Agent, or Firm*—Harvey M. Brownrout; Peter H. Kondo; James P. O'Sullivan

[57] ABSTRACT

There is described an electrophotographic imaging system which includes a laminated cleaning and/or metering blade for removing residual or excess marking or other material from a surface. The blade comprises a relatively hard layer of a smooth, tough material which has low frictional properties and a relatively soft layer of a resilient material which supplies uniform force at the blade-to-surface interface. In operation, an edge of the relatively hard layer of the blade is supported in pressure contact against the surface and relative motion between the blade and surface is produced whereby the blade removes residual or excess marking material from the surface.

5 Claims, 4 Drawing Figures

ELECTROPHOTOGRAPHIC IMAGING SYSTEM INCLUDING A LAMINATED CLEANING AND/OR DOCTOR BLADE

BACKGROUND OF THE INVENTION

The invention is directed to an electrophotographic imaging system and, more particularly, to such a system wherein a laminated cleaning blade is employed to clean residual marking material from a surface or to meter a liquid material from a supply surface.

The formation and development of images on an imaging member of photoconductive materials by electrostatic means is well known. The best known of the commercial processes, more commonly known as xerography, involves forming an electrostatic latent image on the imaging layer of an imaging member by first uniformly electrostatically charging the surface of the imaging layer in the dark and then exposing this electrostatically charged surface to a light and shadow image. The light struck areas of the imaging layer are thus rendered relatively conductive and the electrostatic charge selectively dissipated in these irradiated areas. After the photoconductor is exposed, the latent electrostatic image on this image bearing surface is rendered visible by development with a finely divided colored electroscopic powder material, known in the art as "toner". This toner will be principally attracted to those areas on the image bearing surface having a relative polarity opposite to the charge on the toner and thus form a visible powder image. The developed image can then be read or permanently affixed to the photoconductor in the event that the imaging layer is not to be reused. This latter practice is usually followed with respect to the binder type photoconductive films where the photoconductive insulating layer is also an integral part of the finished copy.

In so-called "plain paper" copying systems, the latent image can be developed on the imaging surface of a reusable photoconductor or transferred to another surface, such as a sheet of paper, and thereafter developed. When the latent image is developed on the imaging surface of a reusable photoconductor, the developed image is subsequently transferred to another substrate and then permanently affixed thereto. Any one of a variety of well-known techniques can be used to permanently affix the toner image to the transfer sheet, including overcoating with transparent films and solvent or thermal fusion of the toner particles to the supportive substrate.

After visible image is transferred to the receiver member typically there remains some residual marking material on the photoreceptor surface. The residual marking material must be removed from the photoreceptor surface prior to the formation of each subsequent reproduction so as not to interfere with the formation thereof.

PRIOR ART

Various techniques are known in the art for cleaning residual marking material from the photoreceptor including, for example, brush cleaning and blade cleaning. U.S. Pat. No. 3,660,863 to Gerbasi discloses a blade cleaning element of a resilient elastomeric material for use in an electrophotographic imaging system. Blades are also used for cleaning residual marking material from surfaces in other reproduction methods. For example, U.S. Pat. No. 2,187,421 teaches doctor blades for removing excess ink from intaglio printing plates or cylinders in gravure printing presses. In one embodiment (see FIG. 2) the doctor blade is a laminated element made up of a layer of soft resilient material and a hard backing layer. In operation, the soft resilient material contacts the surface from which it is desired to remove excess ink. U.S. Pat. No. 2,333,172 also teaches the use of laminated doctor blades in intaglio printing machines.

SUMMARY OF THE INVENTION

It is therefore the object of the invention to provide a novel electrophotographic imaging system.

It is another object to provide such a system which includes a novel laminated cleaning and/or doctor blade.

It is a further object to provide such a cleaning and/or doctor blade comprising a relatively hard layer of a smooth, tough material and a relatively soft layer of a resilient material.

BRIEF SUMMARY OF THE INVENTION

These and other objects and advantages are accomplished in accordance with the invention by providing an electrophotographic imaging system which includes a laminated cleaning and/or doctor or metering blade for removing residual or excess marking or other material from a surface. The blade comprises a relatively hard layer of a smooth tough material which has low frictional properties and a relatively soft layer of a resilient material. In operation, an edge of the relatively hard layer of the blade is supported in pressure contact against the surface while relative motion is produced between the blade and surface whereby the blade removes residual or excess material from the surface.

BRIEF DESCRIPTION OF THE DRAWINGS

For a better understanding of the invention as well as other objects and further features thereof reference is made to the following detailed description of various preferred embodiments thereof together with the accompanying drawings wherein.

DESCRIPTION OF THE PREFERRED EMBODIMENTS

Figure 1:
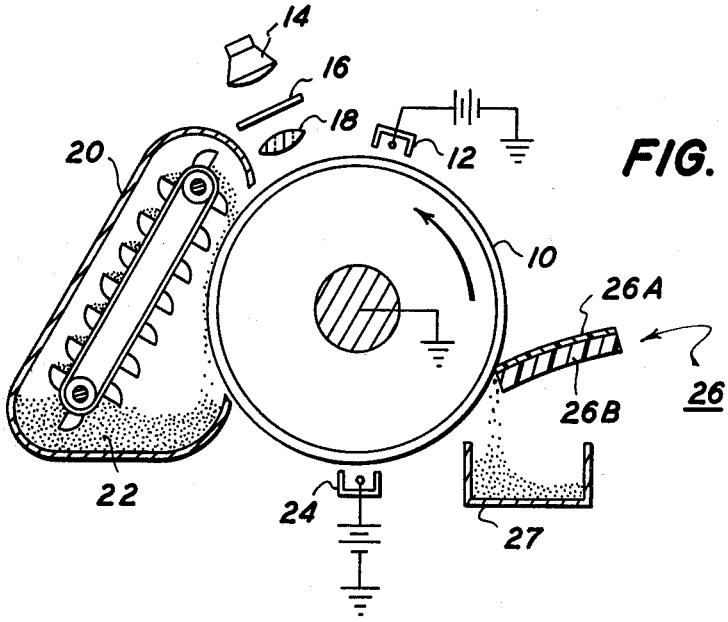
FIG. 1 is a schematic illustration of an electrophotographic imaging apparatus employing the cleaning blade of the invention.

Referring now to FIG. 1, there is seen a photoreceptor generally designated 10, which in this illustrative instance, is shown in the form of a rotating cylinder. Of course, the photoreceptor may be of any configuration such as, for example, a flat plate, an endless recirculating flexible belt, etc. The photoreceptor may be any of those known for use in electrophotography such as, for example, those comprising a conductive substrate carrying a layer of photoconductive insulating material;

those which include an overcoating of an electrically insulating material; those wherein the charge carrier generation and charge carrier transport functions are performed primarily by separate contiguous layers, etc. All such types of photoreceptors and materials for use therein are well known to those skilled in the art and therefore extensive discussion thereof is not required here.

In operation, the photoreceptor is subjected to an electrostatic charging step such as by a corona charging element 12 which includes a corona discharge array of one or more corona discharge electrodes that extend transversely across the photoreceptor surface and are supplied with a high potential electrical current from a suitable high voltage source. The corona discharge electrode is substantially enclosed within a shielding member and is adapted to generate a charge confined within this specific area.

The photoreceptor carrying the electrostatic charge is then exposed to a pattern of radiation to which the photoreceptor is responsive corresponding to an original object. As illustrated, exposure is effected by a projection system comprising a light source 14, transparency 16 and lens 18. Of course, any exposure system may be employed to expose the photoreceptor.

Next the surface of the photoreceptor bearing the electrostatic latent image arrives at a development station 20 whereat a developer composition 22 is presented to the photoreceptor surface. In this illustrative instance the developer composition is cascaded across the surface. However, any suitable electrophotographic development method can be employed such as, for example, liquid development, powder cloud development or magnetic brush development. The marking material is typically attracted to and adheres to the charged areas of the photoreceptor surface thereby forming a visible image corresponding to the electrostatic charge pattern.

Positioned next and adjacent to the development station is the image transfer station where the visible image is transferred to a receiver member (not shown) such as a sheet of paper. Transfer of the visible image to the receiver member can be effected by any of the various methods known to those skilled in the art such as by electrostatic transfer wherein a corona discharge element 24 of a polarity opposite to that of the visible image to be transferred is applied to the receiver member. The receiver member is then stripped from the surface of the photoreceptor and transported through a fixing zone which typically includes heating elements of suitable construction located so as to fuse the visible image to the member.

Figure 2:
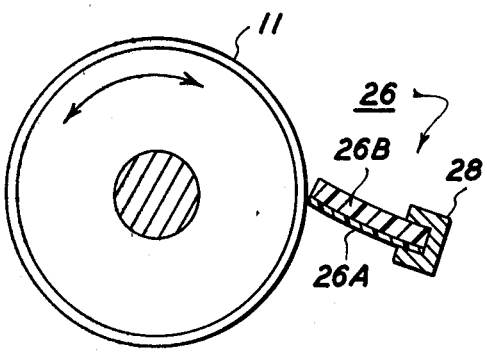
FIG. 2 is a side view showing an embodiment of the blade of the invention supported in pressure contact with a cylinder or roll surface employed in an imaging apparatus.
Figure 3:
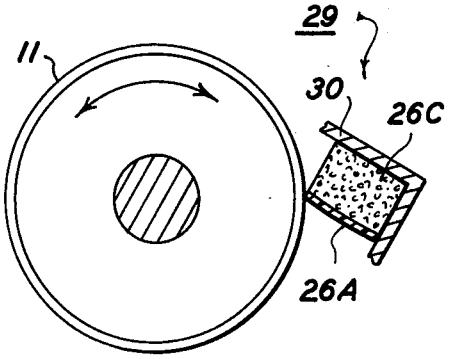
FIG. 3 is a side view showing another embodiment of the blade of the invention supported in pressure contact against a cylinder or roll of an imaging apparatus.

The next station in the electrophotographic reproducing apparatus is the photoreceptor cleaning and toner recovery station at which a cleaning blade 26 in accordance with the invention removes substantially all the residual marking material remaining on the photoreceptor surface and causes it to be directed to recovery hopper 27. The cleaning blade is a laminate made up of a relatively thin layer 26A of a smooth, relatively hard material having a Shore A durometer hardness in the range of from about 60 to about 95 and a relatively thick layer 26B of a soft resilient material having a Shore A durometer hardness of from about 5 to about 50. The blade typically has a thickness of from about 0.05 to about 0.20 inches. The thickness of the relatively soft resilient layer is from about 10 to about 100 times the thickness of the relatively hard material. A convenient thickness for the harder layer is from about 0.005 inches. The blade is arranged so that the layer of smooth relatively hard material is in contact with the photoreceptor surface. The blade may be arranged in a "chiseling" attitude, that is with the blade edge held in a manner to readily cut or chisel the marking material from the surface (FIGS. 2 and 3 clockwise) or in a "wiping" attitude that is, with the edge of the blade arranged to merely pull or wipe the marking material from the surface (FIGS. 2 and 3 counterclockwise). The blade normally rests transversely in pressure contact across the photoreceptor surface and may be held in place by various techniques.

In FIG. 2, blade 26 is also made up of a relatively thin layer of smooth, tough, comparatively hard, low friction material 26A and a layer of relatively thick, comparatively soft, resilient material 26B. This combination is held by a blade channel 28 which is held in place by a spring and frictionless pivots (not shown). Cylinder or roll 11 can be either an electrophotographic plate as in FIG. 1, a liquid developer applicator roll or a liquid release material applicator roll in the toner fusing region of a copying apparatus.

In FIG. 3 the blade 29 is held by a rigid channel 30 against cylinder or roll 11. In this embodiment the blade is compression loaded and supplies the uniform force needed thus eliminating the need for self aligning, spring loaded frictionless pivots on the blade channel. The compression load is provided by employing a foam cushion material as 26C and placing the blade under compression against member 11. The preferred angle of attack for the blade in the chiseling attitude is from about 5 to 30 degrees and for the wiping attitude is from about 30 to 70 degrees. The blade pressure will vary somewhat but will usually be between 0.01 to 2.0 lbs./inch. The blade should, if possible, be positioned so that the removed material will fall away from the blade tip.

Figure 4:
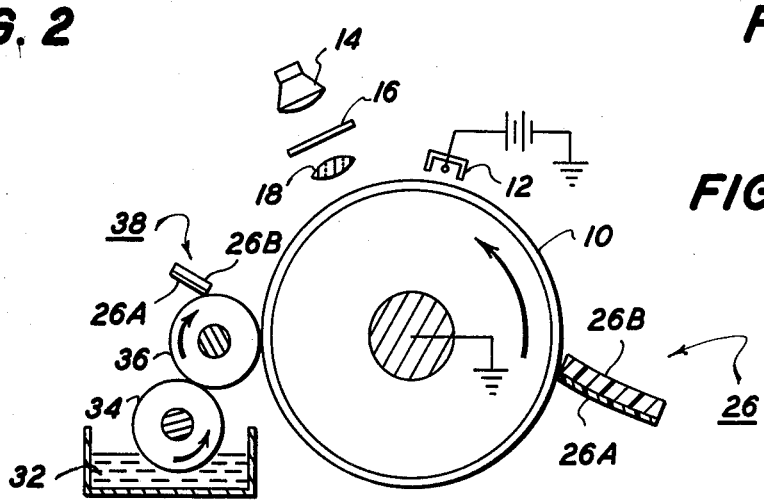
FIG. 4 is a schematic illustration of an electrophotographic imaging apparatus employing a cleaning blade and a doctor blade according to the invention.

FIG. 4 illustrates an embodiment wherein one laminated blade according to the invention is employed to remove excess marking material from a photoreceptor surface and another laminated blade is used to meter the amount of liquid marking material applied to the photoreceptor surface to form a visible image thereon. In this embodiment, the photoreceptor surface is charged and exposed as in the same manner previously described. The electrostatic latent image is then developed with a liquid developer suspension 32. A pickup roll 34 rotating in the liquid developer suspension 32 picks up a thin layer of the suspension and transfers it to an applicator roll 36 which is in contact with the surface of the photoreceptor 10. The amount of the liquid developer suspension presented to the photoreceptor surface is metered by a doctor blade 38 comprising layer 26A and 26B as defined above. The visible image is transferred to a receiver member by any suitable transfer technique and the surface of the photoreceptor is wiped clean of any residual marking material by cleaning blade 26 comprising layer 26A and 26B as defined above.

Any suitable smooth, tough, low friction material may be utilized for the relatively hard layer of the blade. Typical suitable materials include, Viton®, a fluoroelastomer based on the copolymer of vinylidene fluoride and hexafluoropropylene, polyurethane rubbers, silicone rubbers, fluorosilicones, polytetrafluoroethylene, styrene butadiene rubber, nitrile rubber, polyethylene resin and the like having a Shore A durometer hardness of from about 60 to about 95.

Any suitable resilient material having Shore A durometer hardness of from about 5 to 50 may be utilized as the relatively soft layer. Typical suitable materials include all of the species mentioned above which are available in the Shore A hardness of 5 to 50 e.g. polyurethane, polysiloxane etc. Moreover, any polymeric material in a resilient form or porous form having a hardness equivalent to a Shore A hardness of from about 5 to 50, e.g. polyurethane foam.

Laminated blades according to the invention may be prepared by any of many techniques which will be apparent to those skilled in the art. One such technique comprises centrifugally casting a sheet of the relatively soft, resilient material and then spraying or casting thereon a thin layer of the relatively hard, smooth, tough material. Such sheets can then be easily cut into blades.

While the invention has been described in detail with respect to various preferred embodiments thereof, it is not intended to be limited thereto but rather it will be appreciated by those skilled in the art that modifications and variations are possible which are within the spirit of the invention and the scope of the claims.

What is claimed is:

1. In combination an electrophotographic element;

an elongated blade having a relatively thin layer of a smooth, low frictional material having a Shore A durometer hardness in the range of from about 60 to about 95 and a relatively thick layer of a resilient material in porous foam cushion form having a hardness equivalent to a Shore A durometer hardness of from about 5 to about 50;

means adapted to position an edge of said relatively thin layer of said blade in pressure contact with a surface of said element; and means to move said electrophotographic element so as to provide relative movement between said blade and said element.

2. The apparatus as defined in claim 1 wherein said electrophotographic element is a photoreceptor.

3. The apparatus as defined in claim 1 wherein said electrophotographic element is an applicator roll.

4. The apparatus as defined in claim 1 wherein said blade has a thickness of from about 0.05 to about 0.20 inch.

5. The apparatus as defined in claim 1 wherein the thickness of said relatively thick layer of said blade is from about 10 to about 100 times the thickness of said relatively thin layer of said blade.

* * * * *